US006791282B2

(12) United States Patent
Vinocur et al.

(10) Patent No.: US 6,791,282 B2
(45) Date of Patent: Sep. 14, 2004

(54) APPARATUS AND METHOD FOR OPERATING AN APPLIANCE LIGHT

(75) Inventors: Sergio Alberto Vinocur, Louisville, KY (US); John Steven Holmes, Sellersburg, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/997,705

(22) Filed: Nov. 30, 2001

(65) Prior Publication Data

US 2003/0102825 A1 Jun. 5, 2003

(51) Int. Cl.[7] ..... G05F 1/00

(52) U.S. Cl. ..... 315/291; 315/307; 62/264; 62/337

(58) Field of Search ..... 315/362, 363, 315/291, 307; 362/92; 62/259.2, 262, 264, 337, 440, 441, 449

(56) References Cited

U.S. PATENT DOCUMENTS 3,635,043 A 1/1972 Sterling ..... 62/137
4,300,025 A * 11/1981 Prada ..... 200/61.19
4,851,662 A * 7/1989 Ott et al. ..... 250/214 AL
5,113,120 A * 5/1992 Scott et al. ..... 315/77
5,701,235 A 12/1997 Hagemeyer Cook et al. . 362/26
5,787,724 A * 8/1998 Pohl et al. ..... 62/389
5,839,507 A 11/1998 Jensen ..... 165/263
6,199,400 B1 * 3/2001 Banicevic et al. ..... 62/408
6,314,745 B1 11/2001 Janke et al. ..... 62/137

FOREIGN PATENT DOCUMENTS

JP 405141863 A * 6/1993
JP 406034266 A * 2/1994

* cited by examiner

*Primary Examiner*—Thuy Vinh Tran
(74) *Attorney, Agent, or Firm*—H. Neil Houser, Esq.; Armstrong Teasdale LLP

(57) ABSTRACT

A refrigerator includes a fresh food section and a freezer section, wherein at least one of the fresh food section and freezer section includes a door. The door includes an external surface and an internal surface, and a light mounted to the external surface, wherein the light is electrically coupled to a processor-free light fade-out circuit.

18 Claims, 2 Drawing Sheets

APPARATUS AND METHOD FOR OPERATING AN APPLIANCE LIGHT

BACKGROUND OF THE INVENTION

This invention relates generally to an apparatus and method for operating an appliance light, and more particularly to an apparatus and method for energizing and de-energizing an appliance light.

At least some known household refrigerators include a fresh food storage compartment, a freezer storage compartment, and a microprocessor based control system used for operating various components of the refrigerator including a dispensing station light. More specifically, at least some known refrigerators include a dispensing station to enable a consumer to obtain water and ice without opening the refrigerator. The dispensing station may include a dispensing station light which is energized by the microprocessor based control system when an actuator lever is depressed. Such lights may only be energized when the lever is depressed and are de-energized when the lever is released, i.e., no longer depressed. Often, lights may include a separate switch used to energize the light independently of the actuator lever. Inclusion of a microprocessor based light control system during the assembly sequence increases an overall cost of the refrigerator and may increase overall assembly time.

BRIEF DESCRIPTION OF THE INVENTION

In one embodiment, a refrigerator is provided. The refrigerator includes a fresh food section and a freezer section, wherein at least one of the fresh food section and freezer section include a door. The door includes an external surface and an internal surface, and a light mounted to the external surface, wherein the light is electrically coupled to a processor-free light fade-out circuit.

In another embodiment, a processor-free light fade-out circuit is provided. The light fade-out circuit includes a step down circuit, a one-half integrator, a square-wave generator, an integrator, and a voltage comparator wherein the step down circuit is electrically coupled to the one-half integrator, the square-wave generator is electrically coupled to the integrator, and the voltage comparator is electrically coupled to the one-half integrator and the integrator.

In a further embodiment, a method for de-energizing an appliance light is provided. The method includes providing a light bulb, providing a processor-free light fade-out circuit, and electrically coupling the light bulb to the processor-free light fade-out circuit such that the appliance light is de-energized using the processor-free light fade-out circuit.

DETAILED DESCRIPTION OF THE INVENTION

The apparatus and method are described herein in the context of residential, or domestic, refrigerators. The light systems and methods can, however, be utilized in connection with commercial refrigerators. Therefore, the light systems and methods described herein are not limited to use in connection with only residential refrigerators, and can be utilized in connection with dispensing systems in other environments. In addition, light systems and methods are sometimes described herein in the context of a side-by-side type refrigerator. Such systems and methods are not, however, limited to use in connection with side-by-side type refrigerators and can be used with other types of refrigerators, e.g., a top mount type refrigerator.

Figure 1:
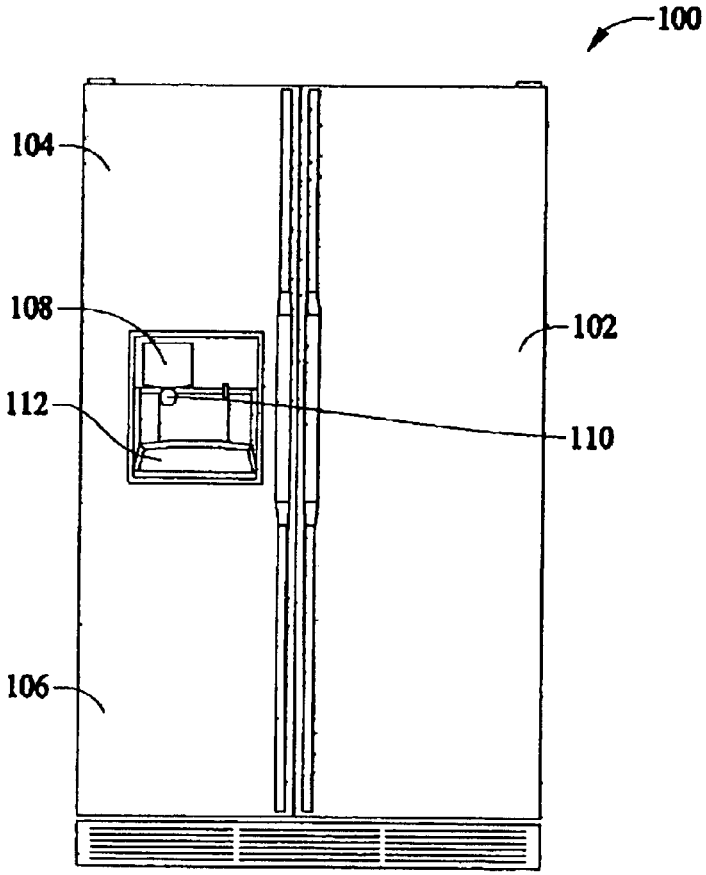
FIG. 1 illustrates a side-by-side type refrigerator.

FIG. 1 illustrates a side-by-side refrigerator 100 including a fresh food storage compartment (not shown) and freezer storage compartment (not shown). Freezer compartment and fresh food compartment are arranged side-by-side. A side-by-side refrigerator such as refrigerator 100 is commercially available from General Electric Company, Appliance Park, Louisville, Ky. 40225.

Refrigerator 100 includes a fresh food section including a fresh food section door 102, and a freezer section including a freezer door 104. In one embodiment, freezer door 104 includes an external surface 106, an internal surface (not shown), and a light 108 mounted to external surface 106. Light 108 includes a light bulb 110. In an alternative embodiment, light 108 is mounted to fresh food section door 102. Light bulb 110 is electrically coupled to a light fade-out circuit. Freezer door 104 also includes a lever 112 for actuating the light fade-out circuit.

Figure 2:
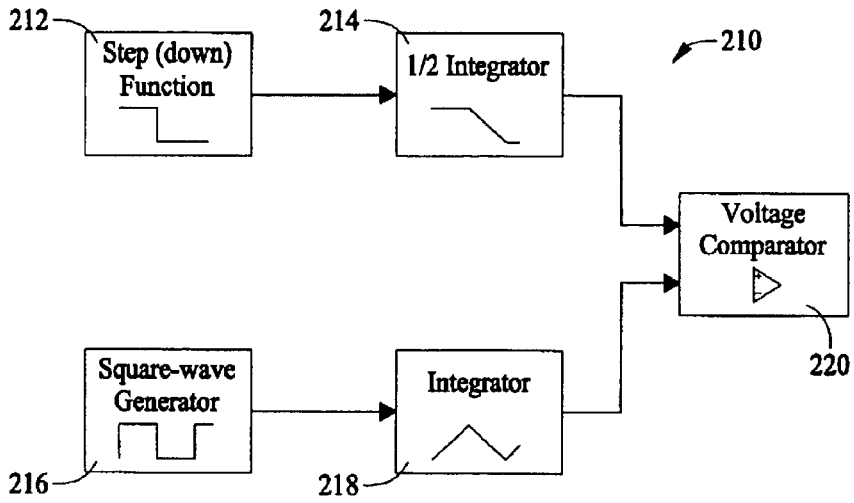
FIG. 2 is a block diagram of an exemplary embodiment of a processor-free light fade-out circuit.

FIG. 2 is a schematic illustration of an exemplary embodiment of a processor-free light fade-out circuit 210 for use with a light, such as light 108 (shown in FIG. 1). As used herein, the term processor is not limited to just those integrated circuits referred to in the art as processors, but broadly refers to computers, microcontrollers, microcomputers, programmable logic controllers, application specific integrated circuits, and other programmable circuits.

In one embodiment, processor-free light fade-out circuit 210 is a pulse width modulation (PWM) fade-out circuit 210 fabricated using a plurality of hardware components as described herein. PWM circuit 210 includes a step down device 212, a one-half integrator 214, a square-wave generator 216, an integrator 218, and a voltage comparator 220.

Figure 3:
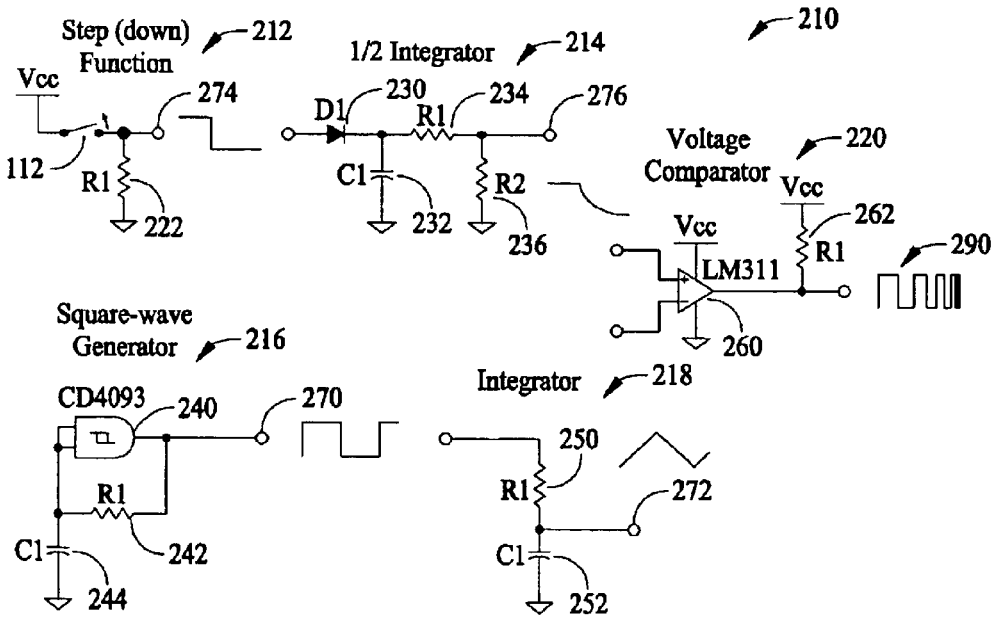
FIG. 3 is a schematic illustration of the exemplary embodiment of the processor-free light fade-out circuit as shown in FIG. 2.

FIG. 3 is a schematic illustration of an exemplary embodiment of processor-free pulse width modulation fade-out circuit 210 (shown in FIG. 2). In one embodiment, step down device 212 includes a resistive circuit 222 such as a single resistor. In another embodiment, resistive circuit 222 includes a plurality of resistors electrically coupled in at least one of a series configuration or a parallel configuration. In an alternative embodiment, step down device 212 includes any device capable of receiving an input voltage and modifying the input voltage to generate an output voltage that is less than the input voltage.

One-half integrator 214 includes a diode 230, such as, but not limited to a zener diode 230. One-half integrator 214 also includes at least one capacitor 232, and at least two resistors, 234 and 236. Capacitor 232, and resistors 234 and 236 are variably selected depending on the desired input and output voltage characteristics of one-half integrator 214.

Square-wave generator 216 includes an integrated circuit (IC) 240, at least one resistor 242 and a capacitor 244. In one embodiment, IC 240 is a digital complementary metal oxide semiconductor (CMOS) IC, such as, but not limited to, a CD4093 CMOS digital IC. For illustrative purposes only, CD4093 is a quad two-input NAND gate chip with a plurality of Schmitt-trigger inputs. Alternatively, square-wave generator 216 is any circuit capable of generating a square-wave with the desired voltage characteristics.

Integrator 218 includes at least one resistor 250 and at least one capacitor 252. In an alternative embodiment, integrator 218 includes a plurality of resistors 250 and a plurality of capacitors 252.

Voltage comparator 220 includes an integrated circuit (IC) 260 and at least one resistor 262. In one embodiment, IC 260 is a circuit such as, but not limited to, a LM311 voltage comparator. IC 260 is designed to operate using supply voltages between approximately −15 volts DC and approximately +15 volts DC.

In use, and referring to FIG. 3, square-wave generator 216 is initialized and generates a square-wave electrical output 270. Square-wave generator output 270 is input to integrator 218. Integrator 218, modifies the square-wave input to generate an integrator output 272, such as, but not limited to, a sawtooth waveform. Integrator output 272 is input as a first voltage input to voltage comparator 220.

Step down circuit 212 is initialized by an operator depressing lever 112. In use, lever 112 is depressed and a step down circuit output voltage 274 is generated across resistive circuit 222. A voltage drop across resistive circuit 222 reduces the input voltage to generate step down circuit output voltage 274 which is less than the input voltage. Step down circuit output voltage 274 is input to one-half integrator 214. In use, diode 230 facilitates preventing a reverse current being input to step-down function device 212. One-half integrator 214 receives step down circuit voltage output 274 and charges capacitor 232. When capacitor 232 is fully charged, i.e. lever 112 is depressed for a predetermined time, a voltage is formed across resistor 234 and resistor 236. Resistor 234 and resistor 236 are variably selected depending on the desired one-half integrator output voltage characteristics and voltage comparator 220 input voltage characteristics. The voltage formed across resistor 236 is the one-half integrator output voltage 276. One-half integrator output voltage 276 is supplied as a second voltage input to voltage comparator 220.

Comparator 220 receives the first voltage input and the second voltage input to generate a pulse width modulation fade-out circuit 210 output voltage. Comparator 220 compares the first input voltage with the second input voltage. Comparator 220 output voltage is generally a maximum output voltage or a minimum output voltage depending on the comparison from the first input voltage and the second input voltage. If the second input voltage is greater than the first input voltage, comparator 220 will generate a high voltage output signal. If the second input voltage is less than the first input voltage, comparator 220 will not produce an output voltage.

In use, the operator depresses lever 112, thus charging capacitor 232, and one-half integrator output voltage 276 is input to comparator 220 as a second input voltage as described herein. Comparator 220 compares the second input voltage, i.e. one-half integrator output voltage 276, which is high when lever 112 is depressed, with the first input voltage, a sawtooth waveform. When lever 112 is depressed, the second input voltage will exceed the first input voltage and a light bulb 110 (shown in FIG. 1) will illuminate. When lever 112 is released, capacitor 232 will discharge at the pre-determined rate, depending on the size of capacitor 232. The second input voltage will decrease over a pre-determined time to comparator 220 while the first input voltage remains a sawtooth waveform. As the second input voltage decreases, the first input voltage will be greater than the second input voltage at comparator 220 causing comparator 220 output voltage to decrease to approximately zero volts. As the first voltage input decreases, i.e. sawtooth waveform decreases, the second voltage input will again exceed the first voltage input causing comparator 220 voltage to increase to approximately maximum. This cycle 290 will continue, thereby causing light bulb 110 to grow dimmer, until capacitor 232 is completely discharged thereby completely distinguishing light bulb 110.

While the invention has been described in terms of various specific embodiments, those skilled in the art will recognize that the invention can be practiced with modification within the spirit and scope of the claims.

What is claimed is:

1. A refrigerator comprising a fresh food section and a freezer section, at least one of said fresh food section and freezer section comprising a door comprising an external surface and an internal surface, and a light mounted to said external surface, said light electrically coupled to a processor-free light fade-out circuit wherein said processor-free light fade-out circuit comprises a step down circuit, a one-half integrator, a square-wave generator, an integrator, and a voltage comparator wherein said step down circuit is directly electrically coupled to an input of said one-half integrator, said square-wave generator is directly electrically coupled to an input of said integrator, and said voltage comparator having two inputs directly electrically coupled to an output of said one-half integrator and an output of said integrator, respectively.

2. A refrigerator in accordance with claim 1 wherein said step down circuit comprises a resistive circuit comprising at least one resistor.

3. A refrigerator in accordance with claim 1 wherein said one-half integrator comprises at least one capacitor and at least two resistors.

4. A refrigerator in accordance with claim 1 wherein said square-wave generator comprises an integrated circuit, at least one resistor, and a capacitor.

5. A refrigerator in accordance with claim 1 wherein said integrator comprises at least one resistor and at least one capacitor.

6. A refrigerator in accordance with claim 1 wherein said voltage comparator comprises an integrated circuit and at least one resistor.

7. A processor-free light fade-out circuit, said light fade-out circuit comprising a step down circuit, a one-half integrator, a square-wave generator, an integrator, and a voltage comparator wherein said step down circuit is directly electrically coupled to an input of said one-half integrator, said square-wave generator is directly electrically coupled to an input of said integrator, and said voltage comparator having two inputs directly electrically coupled to an output of said one-half integrator and an output of said integrator, respectively.

8. A light fade-out circuit in accordance with claim 7 wherein said step down circuit comprises a resistive circuit comprising at least one resistor.

9. A light fade-out circuit in accordance with claim 7 wherein said one-half integrator comprises at lout one capacitor and at least two resistors.

10. A light fade-out circuit in accordance with claim 7 wherein said square-wave generator comprises an integrated circuit, at least one resistor, and a capacitor.

11. A light fade-out circuit in accordance with claim 7 wherein said integrator comprises at least one resistor and at least one capacitor.

12. A light fade-out circuit in accordance with claim 7 wherein said voltage comparator comprises an integrated circuit and at least one resistor.

13. A method for de-energizing an appliance light, said method comprising:

providing a light bulb;

providing a processor-free light fade-out circuit, wherein the processor-free light fade-out circuit comprises a step down circuit, a one-half integrator, a square-wave generator, an integrator, and a voltage comparator wherein the step down circuit is directly electrically coupled to an input of said one-half integrator, said square-wave generator is directly electrically coupled to an input of said integrator, and the voltage comparator having two inputs directly electrically coupled to an output of the one-half integrator and an output of said integrator, respectively; and electrically coupling the light bulb to the processor-free light fade-out circuit such that the appliance light is de-energized using the processor-free light fade-out circuit.

14. A method for de-energizing an appliance light in accordance with claim 13 wherein the step down circuit comprises a resistive circuit comprising at least one resistor and wherein the one-half integrator comprises at least one capacitor and at least two resistors.

15. A method for de-energizing an appliance light in accordance with claim 13 wherein the square-wave generator comprises an integrated circuit, at least one resistor, and a capacitor.

16. A method for de-energizing an appliance light in accordance with claim 13 wherein the integrator comprises at least one resistor and at least one capacitor.

17. A method for de-energizing an appliance light in accordance with claim 13 wherein the voltage comparator comprises an integrated circuit and at least one resistor.

18. A method for de-energizing an appliance light in accordance with claim 13 wherein the appliance is a refrigerator.

* * * * *

UNITED STATES PATENT AND TRADEMARK OFFICE

CERTIFICATE OF CORRECTION

PATENT NO. : 6,791,282 B2
DATED : September 14, 2004
INVENTOR(S) : Vinocur et al.

It is certified that error appears in the above-identified patent and that said Letters Patent is hereby corrected as shown below:

Column 4,
Line 57, delete "at lout" and insert -- at least --.

Signed and Sealed this

Sixth Day of June, 2006

JON W. DUDAS
*Director of the United States Patent and Trademark Office*